US009677733B2

(12) United States Patent
Bauer

(10) Patent No.: US 9,677,733 B2
(45) Date of Patent: Jun. 13, 2017

(54) LIGHT GUIDING ELEMENT FOR A LASER VEHICLE HEADLIGHT

(71) Applicant: ZIZALA LICHTSYSTEME GMBH, Wieselburg (AT)

(72) Inventor: Friedrich Bauer, Bergland (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 474 days.

(21) Appl. No.: 14/384,243

(22) PCT Filed: Feb. 28, 2013

(86) PCT No.: PCT/AT2013/050049
§ 371 (c)(1),
(2) Date: Sep. 10, 2014

(87) PCT Pub. No.: WO2013/134803
PCT Pub. Date: Sep. 19, 2013

(65) Prior Publication Data

US 2015/0078022 A1 Mar. 19, 2015

(30) Foreign Application Priority Data

Mar. 12, 2012 (AT) ..... 50071/2012

(51) Int. Cl.
*F21S 8/10* (2006.01)

(52) U.S. Cl.
CPC ..... *F21S 48/1241* (2013.01); *F21S 48/1145* (2013.01); *F21S 48/1159* (2013.01);
(Continued)

(58) Field of Classification Search
CPC ..... F21S 48/1241; F21S 48/1145; F21S 48/1208; F21S 48/1394; F21S 48/14;
(Continued)

(56) References Cited

U.S. PATENT DOCUMENTS 6,450,991 B1 9/2002 Bunt et al.
2007/0285939 A1 12/2007 Tachibana
(Continued)

FOREIGN PATENT DOCUMENTS

DE 102009025678 A1 1/2010
JP 2011157022 A 8/2011
WO 2010116305 A1 10/2010

OTHER PUBLICATIONS

First Office Action for Austrian priority application No. A 50071/2012 dated Jan. 21, 2013.
(Continued)

*Primary Examiner* — David V Bruce
(74) *Attorney, Agent, or Firm* — Eversheds Sutherland (US) LLP

(57) ABSTRACT

The invention relates to a light guiding element (1) for a laser vehicle headlight (2), wherein the laser vehicle headlight (2) comprises at least one laser light source (3) and at least one luminous element (4) which can be irradiated by the laser light source (3) and can thus be excited to emit visible light. The light guiding element (1) has a first side (10), which is designed at least partly as a light entrance surface (5), and a second side (20) arranged opposite the first side (10), said second side being designed at least partly as a light exit surface (6) and being assigned at least one receptacle (7) for at least one luminous element (4), wherein the light entrance surface (5) is assigned at least one first reflection region (50) which is oriented in the direction of the interior of the light guiding element (1) and reflects light from the light entrance surface (5) in the direction of the receptacle (7) for the luminous element (4), and wherein the light exit surface (6) is assigned at least one second reflection region (60) which is oriented in the direction of the interior of the light guiding element (1) and reflects light from the luminous element (4) in the direction of the light
(Continued)

Figure 1:
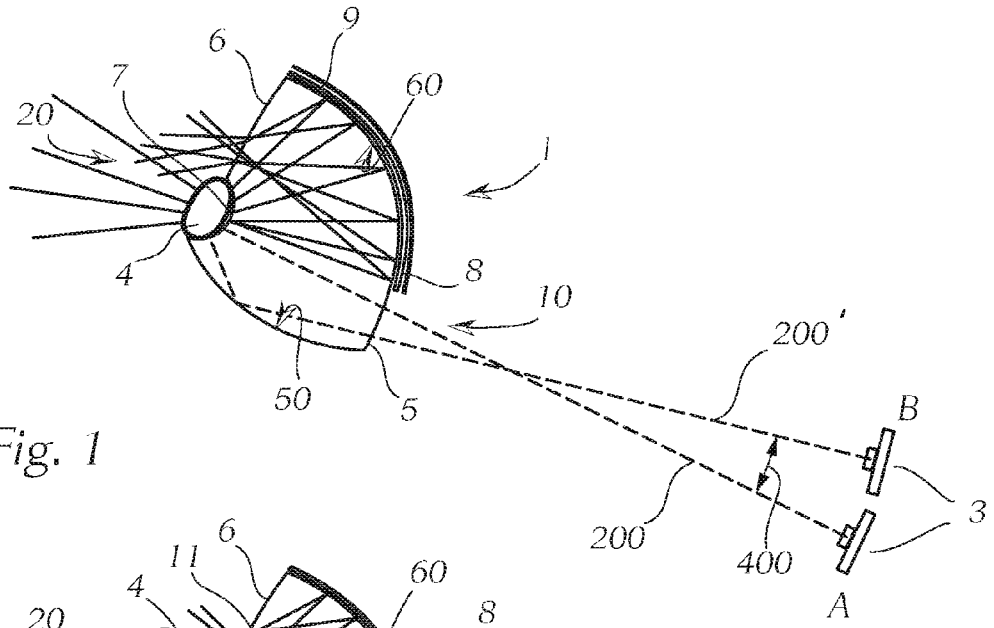

exit surface (6). The invention furthermore relates to a vehicle headlight (2) comprising at least one light guiding element of this type.

17 Claims, 1 Drawing Sheet

(52) U.S. Cl.
CPC ..... *F21S 48/1208* (2013.01); *F21S 48/1225* (2013.01); *F21S 48/1388* (2013.01); *F21S 48/1394* (2013.01); *F21S 48/14* (2013.01); *F21S 48/325* (2013.01); *F21S 48/34* (2013.01)

(58) Field of Classification Search
CPC ..... F21S 48/1225; F21S 48/1159; F21S 48/1388; F21S 48/325; F21S 48/34
See application file for complete search history.

(56) References Cited

U.S. PATENT DOCUMENTS

| | | | | |
|---|---|---|---|---|
| 2011/0148280 | A1 | 6/2011 | Kishimoto et al. | |
| 2011/0249460 | A1 | 10/2011 | Kushimoto | |
| 2012/0063157 | A1* | 3/2012 | Nakazato ..... | F21S 48/1145 362/517 |

OTHER PUBLICATIONS

International Search Report of PCT/AT2013/050049 dated Jun. 13, 2013.

* cited by examiner

LIGHT GUIDING ELEMENT FOR A LASER VEHICLE HEADLIGHT

The invention relates to a light guiding element for a laser vehicle headlight, wherein the laser vehicle headlight comprises at least one laser light source and at least one luminous element which can be irradiated by the laser light source and can thus be excited to emit visible light. The invention additionally relates to a vehicle headlight comprising at least one laser light source and at least one luminous element which can be irradiated by the laser light source and can thus be excited to emit visible light, comprising at least one such light guiding element.

Various types of vehicle headlights are known in the prior art, wherein headlights with discharge lamps and halogen light sources have been used predominantly in recent years. For energy-saving reasons and in order to further reduce the special requirement of vehicle headlights, the use of laser light sources as semiconductor lasers has been increasingly tested, since these are advantageous in this respect. In order to make the laser light usable for a vehicle headlight, a luminous element, or what is known as a phosphor converter (for example a phosphorous compound, a YAG crystal with cerium doping, etc.) is irradiated using a laser light source and is thus excited to radiate visible light. The phosphor converter thus converts laser light into light of other wavelengths.

Free-jet concepts are also often used here, in which the laser light source is distanced from the luminous element and the laser light travels over a free distance before impinging on the luminous element. In such a case, it is necessary for the laser light to impinge precisely on the luminous element—on the one hand in order to utilise the radiated power to the best possible extent and on the other hand for safety reasons. The used laser light sources emit powers of currently up to 3 W and more, and, in the case of a normal function (for example if the luminous element is not contacted optionally), high-intensity laser light radiation that is harmful to the eyes may lead to injuries, but in any case to the endangerment of other road users.

The object of the invention is therefore to provide a solution for laser vehicle headlights that overcomes the above-mentioned problems of the prior art.

This object is achieved in accordance with the invention with a light guiding element as mentioned in the introduction in that the light guiding element has a first side, which is designed at least partly as a light entrance surface, and a second side arranged opposite the first side, said second side being designed at least partly as a light exit surface and being assigned at least one receptacle for the at least one luminous element, wherein the light entrance surface is assigned at least one first reflection region which is oriented in the direction of the interior of the light guiding element and reflects light from the light entrance surface in the direction of the receptacle for the luminous element, and wherein the light exit surface is assigned at least one second reflection region which is oriented in the direction of the interior of the light guiding element and reflects light from the luminous element in the direction of the light exit surface.

On the one hand, the invention makes it possible to compensate for positioning errors of the light guiding element or of the luminous element arranged therein with respect to the laser light source, since, due to the first reflection region, light that does not contact the luminous element exactly is also deflected onto the luminous element. On the other hand, a complete utilisation of the light emitted by the luminous element is enabled, since the second reflection region deflects light emitted from the luminous element towards the light exit surface—this light component otherwise would not be usable. The reflective property of the reflection regions is produced inter alia due to the total reflection at the interface between the light guiding element and the surrounding environment.

Thanks to the solution according to the invention, both the high demands on the mounting of the luminous element relative to the laser light source can thus be reduced and therefore satisfied (for example even in the event of jolting during operation caused by vibrating loads, resonances, thermal expansion, etc.) and a greater luminous efficiency can also be ensured.

The light guiding element preferably consists of a transparent material, such as glass or plastic—the light guiding element is formed for example in one piece as a solid body, that is to say consists continuously of one material. However, it can also be formed as a hollow body.

Preferably, the second reflection region is arranged predominantly on the side of the light guiding element facing the laser light source in the mounted state of the light guiding element. In particular, light that is radiated by the luminous element in the direction of the light entrance surface can be deflected in the direction of the light exit surface and can therefore be made usable. Here, the term "predominantly" is to be understood to mean that more than half of the second reflection region is arranged on the side of the light guiding element facing the laser light source in the mounted state of the light guiding element.

In principle, the reflection regions can be formed arbitrarily. By way of example, the first reflection region can be formed in such a way that incident light is deflected via means of total reflection. In a variant of the invention, the reflection regions are each formed as at least one reflection layer applied to the outer face of the light guiding element and preferably covered by an absorption layer. Here, reflective or absorbing layers can be applied accordingly by vapour deposition, painting or also by mechanical fastening (for example gluing) of corresponding covering parts.

In accordance with an embodiment of the invention, the light guiding element is formed in the region of the first and/or of the second reflection region as a free-form face. Here, the first and/or the second reflection region is/are advantageously formed with at least one focal point. The embodiment of free-form faces is known to a person skilled in the art. In combination with the reflection layer, the reflection regions can thus be adapted for the respective requirement. The forming of the outer region of the light guiding element in combination with the reflection layer enables the effect according to the invention. Besides the embodiment as a free-form face, other embodiments are also possible, for example as paraboloid surfaces.

The second reflection region favourably has at least one focal point in the region of the light exit surface. The light flux of the light distribution can thus be increased, since a virtual light source is created by the provision of a focal point in the region of the light exit surface. Of course, further focal points may also be provided.

The receptacle for the luminous element is formed as a blind bore or as a cavity completely surrounded by the light guiding element. The luminous element can thus be arranged in the light guiding element. This has the advantage that, during mounting, only the light guiding element has to be mounted exactly with respect to the laser light source—the optimal position of the luminous element is thus simultaneously ensured, since the luminous element is held in the light guiding element. With the embodiment of the receptacle as a blind bore, the luminous element can be exchanged as required and the light guiding element can continue to be used. With the embodiment as a completely surrounded cavity, the luminous element can be protected against ambient influences. Due to the provision of the receptacle, the luminous element is arranged in the mounted state "below" the light exit surface in the light guiding element.

In particular with the use of the light guiding element in a vehicle headlight, it is advantageous if there is absolutely no emission of undesirable stray light, which could then falsify the light exposure. In a variant of the invention, the outer face of the light guiding element, with the exception of the light entrance surface, the light exit surface and the reflection regions, is provided at least in regions, but particularly completely, with a light-impermeable and/or reflective coating. It is thus possible to prevent light away from the light exit surface from being emitted from the light guiding element. The coating can be applied by way of example by painting or vapour deposition. When the coating is reflective, it can advantageously assist the decoupling of the light radiated by the luminous element via the light exit surface.

Various light functions can also be provided with the solution according to the invention. In a further variant of the invention, the second side is covered at least in regions by a light-impermeable delimitation element, which is preferably arranged in the region of the receptacle for the at least one luminous element. This light-impermeable delimitation element can be formed for example as a coating in the form of a painted coating or a coating applied by vapour deposition, however a separate component can also be glued on or applied otherwise. A dipped beam with clear light/dark transition can be produced by this delimitation element (possibly in conjunction with a free-form reflector face—see below).

The object of the invention is also achieved in accordance with the invention by a vehicle headlight as mentioned in the introduction in that at least one light guiding element according to the above-described variant is arranged between the laser light source and the luminous element. The invention according to the above embodiments thus allows the provision of a vehicle headlight that can meet the legal requirements, such as ECE, SAE, CCC, etc.

In a variant of the invention, the laser light source is arranged in front of the luminous element as viewed in the main radiation direction of the vehicle headlight, such that the light of the laser light source is emitted against the main radiation direction of the vehicle headlight. In this variant, the endangerment of uninvolved road users in particular is prevented by the laser beam in the event of a malfunction of the headlight—since the laser beam runs against the main radiation direction, it cannot radiate in an uncontrolled manner from the headlight.

As an additional safety element, at least one screen element is favourably provided, by means of which light reflected by the light entrance surface of the light guiding element or from the interior of the light guiding element in the main radiation direction of the vehicle headlight can be shielded. In accordance with a variant of the invention, the screen element is formed as a connection piece running between the laser light source and the light guiding element and is formed in particular in a tubular or semi-tubular manner. The radiation in particular of laser light in a direction outside the vehicle headlight can be prevented with the screen element. To this end, the screen element for example may be coated in a non-reflective or absorbing manner, or may surround the relevant region of the light guiding element.

Figure 2:
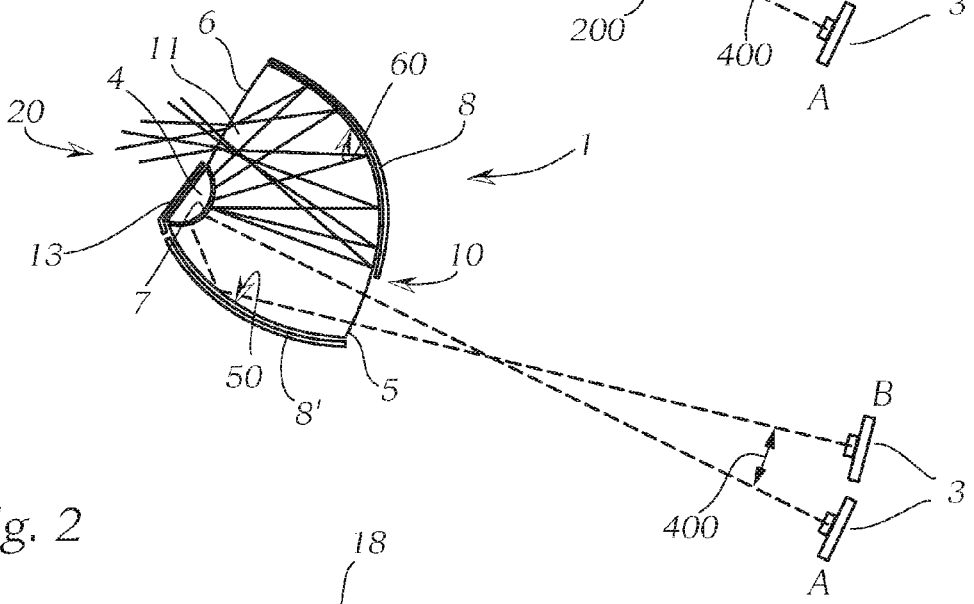
Figure 3:
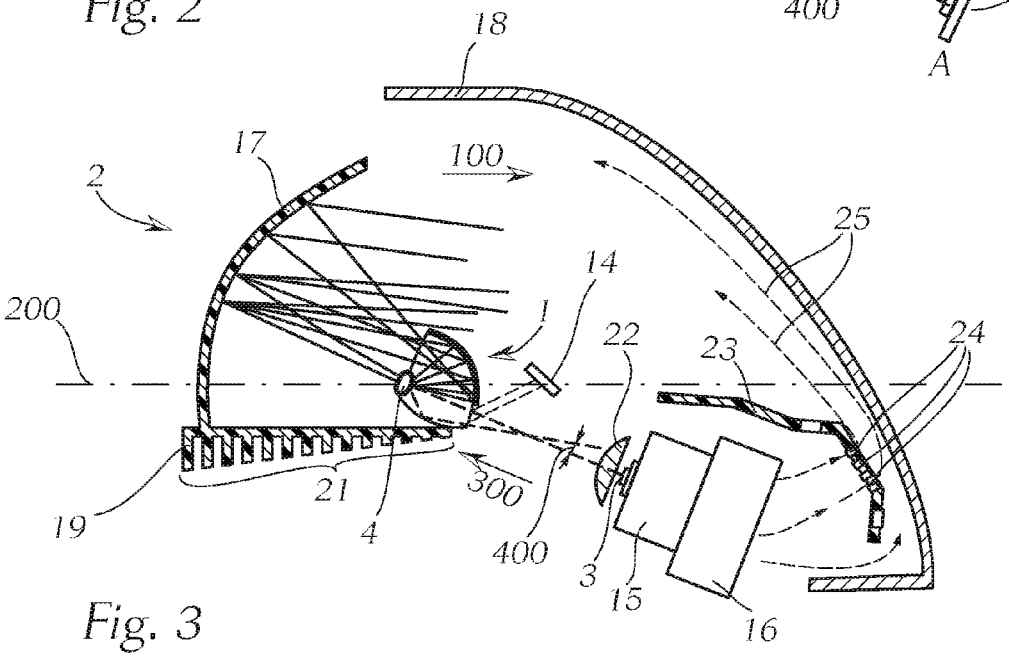

The invention will be explained in greater detail hereinafter on the basis of a non-limiting exemplary embodiment illustrated in the drawing, in which:

FIG. 1 schematically shows a cross-sectional view of a first variant of the light guiding element according to the invention;

FIG. 2 schematically shows a cross-sectional view of a second variant of the light guiding element according to the invention; and FIG. 3 schematically shows a cross-sectional view of a vehicle headlight comprising a light guiding element according to the invention.

In the following figures like elements are denoted in each case by like reference signs for reasons of clarity. Terms used hereinafter such as "above", "below", "front" and "rear" relate to a mounted state in a vehicle, that is to say when the light guiding element 1 is in use in a vehicle headlight 2, wherein the vehicle headlight 1 is installed in a vehicle on the front side.

A first variant of the light guiding element 1 according to the invention is illustrated in FIG. 1. The light guiding element 1 is used for example in a laser vehicle headlight 2 (see FIG. 3), more specifically between a laser light source 3 and a luminous element 4, which is excited by the light radiating from the laser light source 3 to emit visible light, in particular of white colour. In FIG. 1, a laser light source 3 is illustrated in two different positions, as will be explained hereinafter in greater detail.

The light guiding element 1 preferably consists of a transparent material, such as glass or plastic. It can be formed as a one-piece solid body, but in a variant can also be formed as a hollow body. The composition from a number of solid bodies made of different materials is also possible.

The light guiding element 1, on a first side 10, which in the mounted state as indicated in FIG. 1 is located on the side of the laser light source 3, has a light entrance surface 5. Laser light coming from the laser light source 3 can be radiated into the light guiding element 1 via the light entrance surface 5, which takes up part of the first side 10.

A light exit surface 60, which forms part of the second side 20, is located on a second side 20 of the light guiding element 1 arranged opposite the first side 10. Furthermore, the second side 20 is assigned a recess 7 for a luminous element 4. The recess 7 is formed in the illustrated exemplary embodiment as a blind bore, but for example can also be formed as a cavity surrounded completely by the light guiding element 1.

The light entrance surface 5 is assigned a first reflection region 50 oriented in the direction of the interior of the light guiding element 1. The light guiding element 1 or outer face thereof is formed as a free-form face in the region of the first reflection region 50. Light that is incident via the light entrance surface 5 is reflected via the first reflection region 50 in the direction of the receptacle 7 for the luminous element 4. It is thus possible to compensate for positioning errors between the light guiding element 1 and laser light source 3, or an accuracy of the positioning attainable during use can be achieved thanks to the first reflection region 50. FIG. 1 shows the laser light source 3 in two positions A, B. In position A, the laser light source 3 is positioned such that the light beam 200 impinges directly on the luminous element 4.

Position B illustrates a situation in which the relative positioning between laser light source 3 and light guiding element 1 is not optimal. In position B, the light beam 200 is incident in comparison to position A at a certain angle of deviation. The angle of deviation 400 thus denotes the angle between the "optimal" light beam path with laser light source 3 in position A and a slightly shifted light beam path with laser light source 3 in position B. Such a situation may occur for example when the laser light source 3 is displaced due to jolting during operation or due to an improper exchange of the light source. When the laser light source 3 is in position B, the light beam 200' does not impinge directly on the luminous element 4, but is reflected on the first reflection region 50, from which it is reflected in the direction of the receptacle 7 for the luminous element 4. By way of example, total reflection is provided in the first reflection region 50, however a reflective coating may also be provided on the outer face of the light guiding element 1 in the region of the first reflection region 50 in variants of the invention.

The incident light therefore does not have to impinge on the light entrance surface 5 perpendicularly, but can strike within an angle of acceptance. Here, the angle of acceptance denotes the maximum angle at which light can impinge and still be guided to the luminous element 4. Light that is incident at an angle greater than the angle of acceptance is reflected either directly on the light entrance surface 5 or is deflected in such a way in the light guiding element 1 that it does not reach the luminous element 4. The angle of deviation 400 therefore has to be smaller than or equal to the angle of acceptance for proper functioning.

The embodiment of the light entrance surface 5 and of the first reflection region 50 thus increases the tolerances with which the light of the laser light source 3 radiates onto the luminous element 4 and thus on the one hand facilitates the construction of a laser vehicle headlight 2 (see FIG. 3) and on the other hand places less importance on the jolting occurring during operation.

The light exit surface 6 on the second side 20 of the light guiding element 1 is assigned a second reflection region 60 oriented in the direction of the interior of the light guiding element 1. As in the case of the first reflection region 50, the light guiding element 1 is also formed in a known manner as a free-form face in the region of the second reflection region 60. In principle, the light guiding element 1 can also be formed differently both in the region of the first 50 and of the second reflection region 60, for example as a paraboloid surface or otherwise.

In the illustrated exemplary embodiment, the second reflection region 60 is arranged predominantly on a side of the light guiding element 1 facing the laser light source 3 in the mounted state of the light guiding element 1. The second reflection region 60 reflects light originating from the luminous element 4 in the direction of the light exit surface 6. It is thus made possible to utilise to the greatest extent possible the visible light emitted by the luminous element 4—light which for example is radiated by the luminous element 4 in the direction of the laser light source 3 otherwise would not be usable.

In the illustrated exemplary embodiment according to FIG. 1, the second reflection region 60 is formed as a reflection layer 8 applied to the outer face of the light guiding element 1. The reflection layer 8 is generated by way of example by painting or vapour deposition. In a variant, it may also be formed, however, as a reflection element that is applied to the light guiding element 1 in a form-fitting manner, for example by gluing. The reflection layer 8 is covered on its outer face with an absorption layer 9. This has the purpose of effectively preventing light from passing through the reflection layer 8—particularly in the case of application by means of vapour deposition, coating faults may sometimes occur, and therefore the reflection layer 8 is too thin or possibly is not present at all at some points. In such cases, light can be prevented from passing through the reflection layer 8 and can therefore be prevented from interfering with the light exposure by means of the application of the absorption layer 9.

In FIG. 1, in the case of the second reflection region 60, such a combination of reflection layer 8 and absorption layer 9 is provided, whereas the first reflection region 50 is constructed without such layers (deflection by means of total reflection). The reflection properties are produced together with the embodiment of the light guiding element 1 in the region of the first 50 and second reflection region 60—in each case as a free-form face in the illustrated embodiment, as described above.

The second reflection region 60 is formed with at least one focal point 11. The focal point 11 is located in the region of the light exit surface 6. Besides the luminous element 4 as actual light source, a virtual light source is thus also produced at the location of said focal point 11. The light flux of the light distribution can be increased in this way.

In the variant according to FIG. 1, the light guiding element 1 thus emits visible light both from the luminous element 4 and from the virtual light source in the focal point 11.

FIG. 2 now shows a second variant of the light guiding element 1 according to the invention. In this variant, a reflection layer 8' is also formed in the region of the first reflection region 50 on the outer face of the light guiding element 1.

Furthermore, the second side 20 in the region of the receptacle 7 for the luminous element 4 is provided with a light-impermeable delimitation element 13. This is one of many possible embodiments; in principle, the delimitation element 13 is to be provided in regions and can cover various regions of the second side 20. The delimitation element 13 serves to influence the radiated light distribution, for example a dipped beam with clear light/dark transition or also other light functions can thus be produced.

Besides the described embodiment of the light guiding element 1 at the reflection regions 50, 60 and of the layers possibly applied there and of the properties of the light entrance 5 and light exit surface 6, the outer face of the light guiding element 1 can be provided at least in regions, but particularly completely with a light-impermeable and/or reflective coating. Light is thus prevented from exiting in an uncontrolled manner from the light guiding element 1 and thus being able to interfere with the light exposure (for example of a vehicle headlight 2, in which such a light guiding element 1 is used).

The form of the light guiding element 1 can be selected differently. In accordance with the variant in FIGS. 1 and 2, the light guiding element body in the region of the first reflection region 50 is formed as a free-form face, similarly to a paraboloid of revolution, whereas said body in the region of the second reflection region 60 is formed as a free-form face similarly to an ellipsoid form. The embodiment as free-form faces of another type is also possible, such that the light exposure thus meets the legal requirements or homogeneity requirements.

FIG. 3, in a partial cross-sectional view, shows a vehicle headlight 2 with an above-described light guiding element 1. Only the features essential for the understanding of the invention are illustrated, since the other elements of a vehicle headlight are known to a person skilled in the art.

The vehicle headlight 2 comprises a laser light source 3, which for example radiates in a wavelength range between 200 nm and 450 nm, that is to say partly in the non-visible UV range. The radiated power of the laser light source 3 is between 0.5 and 2 W, but may also be higher. By way of example, the laser light source 3 is a semiconductor laser in the form of a laser diode. A number of laser light sources 3 may also be provided, for example in the form of laser diode arrays.

In order to dissipate heat produced during operation, the laser light source 3 in the illustrated exemplary embodiment comprises a heat sink 15 and a ventilation device 16—the ventilation device 16 is used here to supply cool air to the heat sink 15 and to remove heated air. The ventilation device 16 for example may comprise a fan device. The heat sink 15 can be manufactured from a suitable material and may additionally comprise cooling ribs inter alia for example.

Besides the laser light source 3 (illustrated in FIG. 3 with heat sink 15 and fan 16), a luminous element 4 is also provided, which in the present exemplary embodiment is spherical. The spherical embodiment is just one of a number of possible embodiments, that is to say the luminous element 4 can also be formed differently. The luminous element 4 is preferably a phosphor converter, which can be excited by the light of the laser light source 3 in a known manner to emit visible light. In principle, all materials that convert monochromatic laser light into light of other wavelengths (preferably white light) can be used as a phosphor converter. In principle, the phosphor converter is thus a light converter—the electrons of the converter material are excited by the laser light into higher energy levels and, when they drop back, emit light of the wavelength corresponding to the level difference.

The luminous element 4 is arranged in a light guiding element 1 according to the invention, which is positioned in a reflector 17. The light guiding element 1 is the variant according to FIG. 1—that is to say the luminous element 4 contributes directly to the light distribution output via the reflector 17, and the beams reflected by the second reflection region 60 also contribute to said light distribution. Of course, the variant according to FIG. 2 or other embodiments can also be used.

The reflector 17 guides the light radiated by the luminous element 4 in the main radiation direction 100 of the vehicle headlight 2. The main radiation direction 100 runs from left to right in the present example in FIG. 3. The reflector 17 can be arranged so as to be pivotable and/or adjustable, which is not illustrated in the figures for reasons of clarity. In principle, any embodiments of the reflector 17 are possible, and free-form variants, such as parabolas, hyperbolas, ellipses or combinations thereof, can be used as a reflector surface. The reflector 17 is illustrated in cross section in FIG. 3 and can be formed as a half-shell (only the upper or lower part is provided) or as a full reflector, wherein a series of variants for the reflector 17 are known to a person skilled in the art.

In the illustrated variant of the invention, the luminous element 4 is arranged on the optical axis 200 of the vehicle headlight 2 in a focal point of the reflector 17. It should be noted that the reflector 17 can also be formed as a free-surface reflector with a number of different focal points, wherein the luminous element 4 is arranged level in one of these focal points in accordance with the illustrated exemplary embodiment. Of course, it is not absolutely necessary for the luminous element 4 to be arranged in a focal point—it must, however, remain stationary in the reflector in order to achieve a desired light distribution, which is also to be ensured in the event of jolting. The vehicle headlight 2 is closed by a cover panel 18. The cover panel 18 can be formed arbitrarily, but is preferably largely transparent.

The desired light exposure of the vehicle headlight 2 is produced by the light guiding element 1, the luminous element 4 arranged therein and the reflector 17. In addition, the light guiding element 1 according to the invention enables greater tolerances with respect to the relative positioning between the laser light source 3 and luminous element 4, for example when the light source 3 is exchanged due to repair or when the laser light source 3 is no longer located in the optimal position due to jolting during operation. At the same time, the use of the light radiated by the light guiding element 4 in a forward direction, that is to say in the main radiation direction 100 of the vehicle headlight 2, is also possible.

In order to fasten the light guiding element 1 in the reflector 17, a carrier element 19 is provided—the carrier element 19 is provided here with cooling ribs 21, which are used to dissipate the heat produced with the light generation in the luminous element 4 and the light guiding element 1. The cooling ribs 21 are merely an example for heat dissipation elements that can be used here—a range of possibilities are known in this respect to a person skilled in the art and therefore will not be discussed here in greater detail.

The laser light source 3 and the luminous element 4 are arranged such that the light of the laser light source 3 is emitted against the main radiation direction 100 of the vehicle headlight 2. The laser light source 3 is thus arranged in front of the luminous element 4 as viewed in the main radiation direction 100 of the vehicle headlight 2, such that the light of the laser light source 3 is emitted against the main radiation direction 100 of the vehicle headlight 2. The radiation direction 300 of the laser light source 3 thus runs opposite the main radiation direction 100 of the vehicle headlight 2. In the case of damage to the vehicle headlight 2 or a malfunction, the light of the laser light source 3 is thus prevented from escaping and potentially endangering other road users.

The radiation direction 300 of the laser light source 3 preferably runs at an acute angle to the main radiation direction 100 of the vehicle headlight 2. The angle may thus be between 0° and 90°. An angle of 0° thus means that the laser light source 3 is arranged after the luminous element 4 as viewed in the main radiation direction 100 over the optical axis of the vehicle headlight 2. Accordingly, an angle of 90° means that the radiation direction 300 of the laser light source 3 runs normal to the optical axis of the vehicle headlight 2. The optical axis and main radiation direction 100 of the vehicle headlight 2 run substantially parallel to one another. Depending on the available installation space for the vehicle headlight 2 or desired field of use, the light source 3 and light guiding element 1 or luminous element 4 can thus be arranged relative to one another.

A series of elements can be arranged between the laser light source 3 and the light guiding element 1 with the luminous element 4. By way of example, an optical element in the form of a converging lens element 22 is arranged immediately after the laser light source 3 in the illustrated exemplary embodiment according to FIG. 3. This converging lens concentrates the light of the laser light source 3 in the direction of the light guiding element 1 or of the luminous element 4 arranged therein. Of course, any other optical elements can also be used, for example lenses and/or prisms of a wide range of different types.

Absorbing elements are favourably arranged around such optical or light guiding elements 1 in order to prevent any reflections of the incoming laser light in the main radiation direction 100 of the vehicle headlight 2 and thus endangerment of other road users. A screen element 14 is illustrated in FIG. 3 as an embodiment of such an element. Such a screen element prevents a radiation of reflections from the vehicle headlight 2. In a variant or additionally, said optical or light guiding elements 1 and absorbing elements, such as the screen element 14, can also be provided with non-reflecting surfaces or can be formed such that they only reflect or absorb light in the wavelength range of the laser light, but are transparent for visible light and therefore make the headlight components visible. Irregularities, such as inclusions or microstructures can also be provided here and deflect the laser light, make it visible from outside and allow it to serve as a design element.

By way of example, the screen element 14 in FIG. 3 is arranged above a horizontal plane running through the optical axis 200 of the vehicle headlight 2 between the light guiding element 1 and the cover panel 18. However, other solutions known to a person skilled in the art are of course also possible—the only requirement of such devices is that the light functions of the vehicle headlight 2 are not adversely influenced.

The screen element 14 can also be formed such that it covers the entire free-jet region of the laser light, for example in the form of a tube or a tube with semi-circular cross section (half-pipe). In a further variant, it may be semi-mirrored and/or illuminated for design reasons using a dedicated light source (for example a blue LED). Such variants are not illustrated in the figures.

The invention according to the above embodiments allows the provision of a vehicle headlight that can meet the legal provisions, such as ECE, SAE, CCC, etc.

In the case of the vehicle headlight 2 according to the variant in FIG. 3, the waste heat produced during operation of the laser light source 3 can additionally be used. In the exemplary embodiment according to FIG. 3, the laser light source 3 is arranged beneath a horizontal plane running through the optical axis 200 of the vehicle headlight 2 in the installed state of the vehicle headlight 2, close to the cover panel 18. In FIG. 3, the horizontal plane runs normal to the drawing plane through the optical axis 200 of the vehicle headlight 2.

The laser light source 3 is arranged so close to the cover panel 18 that the cover panel 18 can be heated by means of the waste heat of the laser light source 3. The waste heat can be used to de-mist and de-ice the cover panel 18. Depending on the used laser light source 3 or depending on the material of the cover panel 18, etc., a decision is to be made as to how close the laser light source 3 must be positioned to the cover panel 18. The ventilation device 16 of the laser light source 3 can be used here in an assisting manner by guidance of the waste heat flow. In accordance with the variant in FIG. 3, the laser light source 3 is positioned below a design screen element 23, which has corresponding design screen openings 24 to allow the passage of the waste heat. These design screen openings 24 may have a nozzle-shaped form in accordance with a variant, such that the airflow 25 caused by the waste heat of the laser light source 3 can be selectively guided. Here, a nozzle-shaped form is to be understood to mean a form that allows the guidance of the airflow 25 passing through the design screen openings 24 in order to perform the above-stated task. The de-misting and de-icing, or quite generally the use of the waste heat of the laser light source 3, can thus be performed more efficiently.

The invention claimed is:

1. A light guiding element (1) for a laser vehicle headlight (2), wherein the laser vehicle headlight (2) comprises at least one laser light source (3) and at least one luminous element (4) which can be irradiated by the laser light source (3) and can thus be excited to emit visible light, wherein the light guiding element (1) has a first side (10), which is designed at least partly as a light entrance surface (5), and a second side (20) arranged opposite the first side (10), said second side being designed at least partly as a light exit surface (6) and being assigned at least one receptacle (7) for the at least one luminous element (4), wherein the light entrance surface (5) is assigned at least one first reflection region (50) which is oriented in the direction of the interior of the light guiding element (1) and reflects light from the light entrance surface (5) in the direction of the receptacle (7) for the at least one luminous element (4), and wherein the light exit surface (6) is assigned at least one second reflection region (60) which is oriented in the direction of the interior of the light guiding element (1) and reflects light from the luminous element (4) in the direction of the light exit surface (6).

2. The light guiding element (1) according to claim 1, wherein the second reflection region (60) is arranged predominantly on the side of the light guiding element (1) facing the laser light source (3) in the mounted state of the light guiding element (1).

3. The light guiding element (1) according to claim 1, wherein the second reflection region (60) and/or the first reflection region (50) is/are formed as at least one reflection layer (8, 8') applied to the outer face of the light guiding element (1).

4. The light guiding element according to claim 3, wherein the at least one reflection layer is covered by an absorption layer.

5. The light guiding element (1) according to claim 1, wherein the light guiding element (1) is formed as a free-form face in the region of the first reflection region (50) and/or the second reflection region (60).

6. The light guiding element (1) according to claim 5, wherein the first reflection region (50) and/or the second reflection region (60) is/are formed with at least one focal point (11).

7. The light guiding element (1) according to claim 5, wherein the second reflection region (60) has at least one focal point (11) in the region of the light exit surface (6).

8. The light guiding element (1) according to claim 1, wherein the receptacle (7) for the luminous element (4) is formed as a blind bore or as a cavity completely surrounded by the light guiding element (1).

9. The light guiding element (1) according to claim 1, wherein the outer face of the light guiding element (1), with the exception of the light entrance surface (5), the light exit surface (6) and the reflection regions (50, 60), is provided at least in regions with a light-impermeable and/or reflective coating (12).

10. The light guiding element according to claim 9, wherein the outer face of the light guiding element is completely covered with the light-impermeable coating and/or reflective coating.

11. The light guiding element (1) according to claim 1, wherein the second side (20) is covered at least in regions by a light-impermeable delimitation element (13).

12. The light guiding element (1) according to claim 11, wherein the light-impermeable delimitation element (13) is arranged in the region of the receptacle (7) for the at least one luminous element (4).

13. A vehicle headlight (2) comprising:

at least one laser light source (3); and at least one luminous element (4) which can be irradiated by the laser light source (3) and can thus be excited to emit visible light, wherein at least one light guiding element (1) according to claim 1 is arranged between the laser light source (3) and the luminous element (4).

14. The vehicle headlight (2) according to claim 13, wherein the laser light source (3) is arranged in front of the luminous element (4) as viewed in the main radiation direction (100) of the vehicle headlight (2), such that the light of the laser light source (3) is emitted against the main radiation direction (100) of the vehicle headlight (2).

15. The vehicle headlight (2) according to claim 13, wherein at least one screen element (14) is provided, by means of which light reflected by the light entrance surface (5) of the light guiding element (1) or from the interior of the light guiding element (1) in the main radiation direction (100) of the vehicle headlight (2) can be shielded.

16. The vehicle headlight (2) according to claim 15, wherein the screen element (14) is formed as a connection piece running between the laser light source (3) and the light guiding element (1).

17. The vehicle headlight (2) according to claim 16, wherein the at least one screen element (14) is formed in a tubular or semi-tubular manner.

* * * * *